US006158313A

United States Patent [19]

Schlecht et al.

[11] Patent Number: 6,158,313

[45] Date of Patent: Dec. 12, 2000

[54] PROCESS FOR CONVEYING THICK MATTER CONTAINING PRESHREDDED SCRAP METAL OR SIMILAR SOLIDS

[75] Inventors: Karl Schlecht, Filderstadt; Ulrich Schuster, Waldkraiburg; Wolfgang Zey, Eningen, all of Germany

[73] Assignee: Putzmeister Aktiengesellschaft, Aichtal, Germany

[21] Appl. No.: 09/415,677

[22] Filed: Oct. 8, 1999

Related U.S. Application Data

[62] Division of application No. 08/888,951, Jul. 7, 1997, Pat. No. 5,988,028, which is a continuation of application No. 08/495,570, filed as application No. PCT/EP93/03438, Dec. 7, 1993, abandoned.

[30] Foreign Application Priority Data

Feb. 2, 1993 [DE] Germany ..... 43 02 799

[51] Int. Cl.[7] ..... B23Q 15/013; B30B 1/32

[52] U.S. Cl. ..... 83/19; 83/13; 83/23; 83/39; 83/72; 83/438; 83/338; 83/686; 83/639.1; 83/169; 83/368; 100/98 R; 91/196; 91/420; 91/436; 409/185

[58] Field of Search ..... 83/13, 19, 23, 83/24, 34, 39, 49, 162, 168, 438, 338, 686, 639.1, 639.2, 639.5, 62, 63, 72, 62.1, 169, 167, 368, 563, 566; 409/185; 91/1, 28, 196, 420, 436; 241/278.1, 280, 281; 100/98 R, 269.06, 269.14, 269.18

[56] References Cited

U.S. PATENT DOCUMENTS

| | | | |
|---|---|---|---|
| 2,061,425 | 11/1936 | Karstens | 103/227 |
| 2,598,203 | 5/1952 | Acker, Jr. | 91/196 X |
| 3,384,007 | 5/1968 | Boje et al. | 100/49 |
| 3,398,693 | 8/1968 | Schumann | 103/49 |
| 3,559,823 | 2/1971 | Ostrin | 214/23 |
| 3,563,164 | 2/1971 | Carkhuff | 100/98 R |
| 3,563,168 | 2/1971 | Doninger | 100/215 |
| 3,576,161 | 4/1971 | Wright | 100/269.06 X |
| 3,604,313 | 9/1971 | Fruehauf | 91/436 X |
| 3,613,711 | 10/1971 | Wilke | 91/436 X |
| 3,693,541 | 9/1972 | Lombard et al. | 100/98 R X |
| 3,802,337 | 4/1974 | St-Hilaire | 100/98 |

(List continued on next page.)

FOREIGN PATENT DOCUMENTS

| | | | |
|---|---|---|---|
| 1 349 263 | 11/1962 | France . | |
| 1 963 382 | 6/1971 | Germany . | |
| 1 653 605 | 12/1971 | Germany . | |
| 2 010 112 | 12/1971 | Germany . | |
| 2 257 455 | 5/1973 | Germany . | |
| 2 315 857 | 10/1974 | Germany . | |
| 2 423 386 | 12/1974 | Germany . | |
| 2 509 081 | 9/1975 | Germany . | |
| 3 048 800 | 7/1982 | Germany | 83/438 |
| 3 048 843 | 7/1982 | Germany | 83/438 |
| 3 103 942 | 10/1982 | Germany . | |
| 3 530 550 | 3/1987 | Germany . | |
| 3 605 723 | 8/1987 | Germany . | |
| 4 102 062 | 8/1991 | Germany . | |
| 92 08 276 U | 10/1992 | Germany . | |
| 3 490 354 | 2/1993 | Germany . | |
| 0 182 332 | 7/1990 | Japan | 83/168 |
| 513 378 | 11/1971 | Switzerland . | |
| 568 481 | 10/1975 | Switzerland . | |

OTHER PUBLICATIONS

Draft English translation of Swiss Patent Document No. 513 378.

*Primary Examiner*—M. Rachuba
*Assistant Examiner*—Boyer Ashley
*Attorney, Agent, or Firm*—Flynn, Thiel, Boutell & Tanis, P.C.

[57] ABSTRACT

Thick matter and solids are conveyed together and substantially continuously through a conveyor pipeline. The thick matter is forced by a conveyor piston driven by a piston pump from a feed container into a conveyer cylinder. A forward face of the piston has a cutting crown with a cutting edge cooperating with an annular cutting ring to cut off solids projecting beyond an inlet in the conveyer pipeline.

16 Claims, 9 Drawing Sheets

U.S. PATENT DOCUMENTS

| | | | |
|---|---|---|---|
| 3,827,347 | 8/1974 | Gilman | 100/98 R X |
| 3,828,663 | 8/1974 | Poplinski | 100/42 |
| 3,908,515 | 9/1975 | Johnson | 91/420 |
| 4,096,797 | 6/1978 | Seiler et al. | 100/39 |
| 4,322,023 | 3/1982 | Olson | 222/380 |
| 4,492,154 | 1/1985 | Rupp et al. | 100/269.06 X |
| 4,610,193 | 9/1986 | Barker et al. | 91/420 |
| 4,958,548 | 9/1990 | Schulze | 91/420 |
| 5,030,069 | 7/1991 | Olson | 417/489 |
| 5,042,362 | 8/1991 | Schulze | 91/436 X |
| 5,065,665 | 11/1991 | Kimura | 91/433 |
| 5,188,022 | 2/1993 | Benson et al. | 100/98 R X |
| 5,347,921 | 9/1994 | Gourdol | 100/98 R |
| 5,351,613 | 10/1994 | Newsom | 100/98 R |
| 5,988,028 | 11/1999 | Schlecht et al. | 83/72 |

PROCESS FOR CONVEYING THICK MATTER CONTAINING PRESHREDDED SCRAP METAL OR SIMILAR SOLIDS

This is a Divisional application of U.S. Ser. No. 08/888,951, filed Jul. 7, 1997, Now U.S. Pat. No. 5,988,028, which is a continuation of U.S. Ser. No. 08/495 570, filed Jul. 27, 1995, now abandoned, which is a 371 of PCT/EP93/03438, filed Dec. 7, 1993.

FIELD OF THE INVENTION

The invention relates to a method for conveying thick matter containing preshredded scrap metal or similar solids, and a method for conveying of shredded scrap metal, melted-on sheet-metal parts or similar solids. The invention relates furthermore to a device for conveying thick matter containing preshredded scrap metal or similar solids.

BACKGROUND OF THE RELATED ART

To burn special waste in special waste furnace systems, which is delivered in containers, in particular in barrels of sheet metal or plastic, two methods have up to now been mainly used. The barrels are in the first method unshredded and moved by gripping means into a furnace, which is mostly designed as a rotary furnace and are there burnt together with their contents at high temperatures. This, however, results in intermittent variations in the combustion temperature, the exhaust gas amounts and the concentration of damaging substances in the exhaust gas so that the capacity of the system must be designed higher than for a continuous supply of special wastes. The filled containers, which due to their contamination with the special waste contained therein must also be burnt, are in a second method preshredded in a shredder. The scrap metal and other solids are separated in a drummed revolving screen from the special waste, which exists mostly in the form of a pasty or pulplike thick matter, before both fractions are subsequently continuously fed to the combustion furnace. Such a method, however, requires devices both for feeding the thick matter and also for feeding the solids into the combustion furnace.

Moreover, when the special waste and containers are burnt together, waste consisting of rusty melted sheet-metal or iron parts accumulates, which waste exists mainly in small pieces or in granular form, and, which should be burnt again because of its residual heating value and in order to reduce the amount of combustion residues.

Starting out from this the basic purpose of the invention is to develop a method and a device of the above-mentioned type, which enable an essentially continuous conveying of thick matter containing preshredded scrap metal or similar solids.

SUMMARY OF THE INVENTION

This purpose is attained according to the invention by a method, in which the thick matter containing the preshredded scrap metal is pressed from a feed container into a conveyor cylinder by a plungerlike conveyor piston, which feed container snugly fits with its bottom under the conveyor piston and is defined or closed on the inlet side during each conveying stroke, and scrap projecting thereby over an inlet opening of the conveyor cylinder on the side of the container from the feed container into the conveyor cylinder is cut off by the conveyor piston entering with its front forward end into the conveyor cylinder. The basic thought of the invention thereby is to move the thick matter containing the preshredded container scrap with a piston pump since piston pumps have proven to be excellent for conveying thick matter with varying liquid content, and to cut during the conveying only the container scrap, which would in an uncut state hinder the conveying.

With regard to the conveying of waste of melted sheet-metal parts and the like, the purpose is attained according to the invention in such a manner that the waste is mixed with a thick matter or a liquidlike medium, and the mixture is subsequently pressed by a conveyor piston from a feed container, which snugly fits on the bottom side under the conveyor piston and is limited or closed on the inlet side during each conveying stroke, into a conveyor cylinder, whereby sheet-metal parts or the like projecting over an inlet opening of the conveyor cylinder on the container side from the feed container into the conveyor cylinder are cut off by the conveyor piston when same enters with its front forward end into the conveyor cylinder.

A preferred embodiment of the invention provides that the projecting parts are cut off between at least one edge, which at least partly surrounds the inlet opening of the conveyor cylinder, and at least one cutting edge, which is arranged on the forward end of the conveyor piston and passes during entry of the conveyor piston into the conveyor cylinder with little space by the edge. This approach makes it possible to exclusively cut the solids, which during entry of the conveyor piston into the conveyor cylinder are partly in the feed container and partly in the conveyor cylinder. The energy needed for the cutting thus is clearly reduced.

According to an advantageous embodiment of the invention a rotary movement about the conveyor piston axis is superposed over the translational movement of the conveyor piston during its forward movement in order to improve the cutting action between the stationary edge and the cutting edge at the forward end of the conveyor piston. The rotary movement of the conveyor piston can take place, for example, hydraulically through a rotary piston of a drive cylinder.

In the case of larger or thicker solids projecting from the conveyor cylinder into the feed container, which cannot be easily cut off, a further preferred embodiment of the invention provides that upon exceeding a specified pressure in the pressure oil driving the conveyor piston the feeding speed of the conveyor piston is reduced without thereby reducing the conveying capacity of a driving pump driving the conveyor piston. Thus it is possible to increase the feeding force and consequently the shearing force for cutting larger solids and to again reduce same after the cutting. If solids that settled between the conveyor piston and inlet opening cannot be cut off even with this measure, a further advantageous embodiment of the invention provides that the conveyor piston is pulled back in the pressure oil cycle upon exceeding a specified pressure and subsequently is again moved forwardly. Solids blocking the path of the piston are shifted by the suction action during the pulling back of the conveyor piston so that during the following pressure stroke of the conveyor piston they are completely in the conveyor pipeline or in the feed container or extend through the inlet opening of the conveyor cylinder with a lesser shearing cross section. In case a cutting off of the solids does not occur immediately even with this measure, this process can be repeated automatically several times before the pump is stopped.

A further advantageous embodiment of the invention provides that the thick material in the conveyor cylinder is prevented from moving back during a suction stroke of the conveyor piston by closing a slide member arranged in the conveyor cylinder, which slide member is opened synchronously with the movement of the conveyor piston always when the conveyor piston is fully retracted and is closed when the conveyor piston is fully moved out.

With respect to the device, the basic purpose of the invention is attained by the conveyor piston entering the conveyor cylinder during its feeding movement and having cutting means at its front forward end, which cutting means cooperate with cutting means in the area of an inlet opening of the conveyor cylinder on the side of the container in order to cut off the solids projecting from the feed container into the conveyor cylinder during entry of the conveyor piston into the conveyor cylinder.

According to a preferred embodiment of the invention the cutting means consist of at least one edge at least partly surrounding the inlet opening of the conveyor cylinder and at least one cutting edge arranged on the forward end of the conveyor piston and passing with little space by the edge during entry of the conveyor piston into the conveyor cylinder, whereby the edge and the cutting edge consist preferably of a hard metal or a hardened steel. Whereas the edge is advantageously constructed on a cutting ring of hardened steel or of hard metal, which is arranged at the end of the conveyor cylinder on the side of the container, the cutting edge is preferably arranged on a cutting crown releasably fastenable on the front forward end of the conveyor piston between a front surface and a peripheral surface of the conveyor piston. The rotating cutting edge can be designed zigzaglike or wavelike in conveying direction and/or in a radial direction so that the solids projecting from the feed container into the conveyor cylinder are not acted upon with a blunt cutting method but shearingly thus enabling an easier splitting of the solids. As an alternative to this or in addition it is also possible to design the edge of the inlet opening zigzaglike or wavelike.

The zigzaglike design of the cutting edge is achieved according to a further advantageous embodiment of the invention in such a manner that it is formed by cutting members, which are arranged ringlike side-by-side and project forwardly over the cutting crown, which is advantageously designed in one piece with this cutting crown.

In order to ease the guiding of the conveyor piston, which is not guided in the area of the feed container, into the inlet opening of the conveyor cylinder, the cutting crown, which is arranged at the front forward end of the conveyor piston, and the outside diameter of which corresponds with the outside diameter of the conveyor piston, advantageously has a conical bevel in the area of the cutting edge.

According to a further advantageous embodiment of the invention, the conveyor piston has on its peripheral surface in the area of its front forward end at least one annular groove, with which the sealing of the annular gap measuring several tenths of millimeters between the conveyor piston and the conveyor cylinder is improved. The annular groove replaces elastic seals usually arranged at this point, which seals would be easily damaged by the metal parts being conveyed and thus would be no longer usable.

Since the annular groove or the annular grooves, however, cannot prevent entry of smaller metal parts into the annular gap between the conveyor piston and conveyor cylinder during the pressure stroke, an inner wall surface of a partial piece of the conveyor cylinder, which partial piece follows the feed container, and an outer peripheral surface of the conveyor piston, which peripheral surface lies opposite the inner wall surface when the conveyor piston is moved out, are hardened. A distortion occurring during hardening of the conveyor cylinder partial piece and of the conveyor piston can be compensated by the partial piece of the conveyor cylinder and the conveyor piston being convexly prerolled during manufacture so that the distortion during hardening results in an adjustment to the exact cylinder surfaces.

Differing from conventional piston pumps, in which the feed container in its lower part was always designed deeper and wider than the conveyor piston cross section in order to prevent a wear of elastic seals arranged on the forward end of the conveyor piston, the lower part of the feed container has according to a further preferred embodiment of the invention a cross section, which corresponds essentially with the cross section of a preferably semicircular conveyor piston segment. With this measure metal parts projecting in the lower half of the conveyor piston cross section from the conveyor pipeline can be avoided so that cutting means are actually not needed in the area of the lower half of the conveyor piston and the lower half of the inlet opening. Alternatively thereto it is also possible to reinstall symmetrically designed cutting means rotated at 180 degrees after a one-sided wear. In order to prevent a rubbing of the peripheral surface of the conveyor piston in the lower part of the feed container in spite of a slight bending of the conveyor piston which is not guided in the area of the feed container and in the area of a surface of the bottom of the feed container, which surface is rougher compared with the surface of the hydraulic cylinder, the cross section of the lower part of the feed container preferably is larger than the conveyor piston diameter by some tenths of a millimeter. The bottom of the feed container can be designed out of a wearing plate as a releasably fastenable lining.

A further preferred embodiment of the invention provides that the conveyor piston is designed as a plunger cylinder and can be moved hydraulically relative to a piston of a stationary piston rod extending into the plunger cylinder, whereby a pressure chamber arranged on the conveying side between the piston and the plunger cylinder together with a pressure chamber arranged on the rod side between the piston and the plunger cylinder can be loaded with pressure oil during a pressure stroke, and whereby upon exceeding a specified pressure in the pressure chambers, which are connected with one another, the connection is closed and the pressure chamber on the rod side is connected pressureless to a return-flow tank. If in such an arrangement the pressure chamber on the conveying side has a cross section which is twice as large as the cross section of the pressure chamber on the rod side, it is possible to double the feeding force and thus the shearing force at the forward end of the conveyor piston by a constant driving performance of a driving pump loading the plunger cylinder with pressure oil while cutting in half the feeding speed.

According to a further advantageous embodiment of the invention, a bridge breaker is arranged in the area of the feed container, which bridge breaker presses the thick matter into the feed container, and in this manner guarantees that material bridges in the feed container are destroyed, and that the thick matter cannot escape upwardly through a funnel tube of the feed container during the forward movement of the conveyor piston but is pressed through the inlet opening into the conveyor cylinder.

In order to prevent the thick matter which is pressed during the pressure stroke of the conveyor piston into the conveyor cylinder from again being moved back into the feed container during the suction stroke of the conveyor piston, a slide member is provided, which is arranged in the conveyor cylinder, releases the conveyor cylinder prior to a pressure stroke of the conveyor piston, and closes the conveyor cylinder prior to a suction stroke of the conveyor piston. The slide member cycles synchronously with the conveyor piston and is arranged directly behind the point at which with a fully extended conveyor piston its front forward end is located.

In order to guarantee that the solids conveyed together with the thick matter cannot lead to a jamming of the slide member, the slide member according to the invention has a slide plate movable in a guideway and engaging the conveyor cylinder, which slide plate at least the edge opposite the guideway has a keylike cross section extending in a feeding direction. The key shape of the edge guarantees that material, which penetrates during a pulling back of the slide member out of the conveyor cylinder into the guideway, is easily moved out again and does not settle in the narrow gap between the guideway and the slide plate and thus result in a jamming of the slide plate.

The edge of the slide plate, which edge lies opposite the guideway, is thereby advantageously adapted in its contour to the inside cross section of the conveyor cylinder, and rests, with the slide member being closed, against a stop fitted into the conveyor cylinder opposite the guideway, which stop has a semicircular stop surface corresponding to the inside cross section of the conveyor cylinder.

When the slide member is closed, solids that possibly exist in the path of the slide member are pressed by the slide plate against the stop surface. The slide member cannot be completely closed at that time, however, the jammed solids also prevent a flowing back of the thick matter from the conveyor cylinder into the feed container.

To improve the filling ratio in the feed container, a preferred embodiment of the invention suggests that a feed chute ending in the feed container and a preferably hydraulically operable tamper member, which can be fed in direction of the feed container into the feed chute, are provided. The tamper member is thereby movable advantageously inclined into the feed chute preferably up to the feed container. To avoid a bridge formation in the feed chute, a preferably hydraulically operable bridge-breaker member is advantageously provided, which can be fed essentially transversely with respect to the path of movement of the tamper member into the feed chute, and which bridge-breaker member can be fed advantageously above the tamper member transversely or inclined in the direction of the feed container into the feed chute. The feed chute has two flanges arranged inclined on the sleeve of the chute for fastening of a tamper cylinder and a bridge-breaker cylinder. Attention must be paid when operating the conveyor device that the conveyor piston, which is preferably designed as a plunger cylinder, the tamper member, the bridge-breaker member and the slide member are cyclically controlled in a suitable manner through a center control.

BRIEF DESCRIPTION OF THE DRAWINGS

The invention will be discussed in greater detail hereinafter in connection with one preferred embodiment schematically illustrated in the drawings, in which.

DETAILED DESCRIPTION

Figure 1:
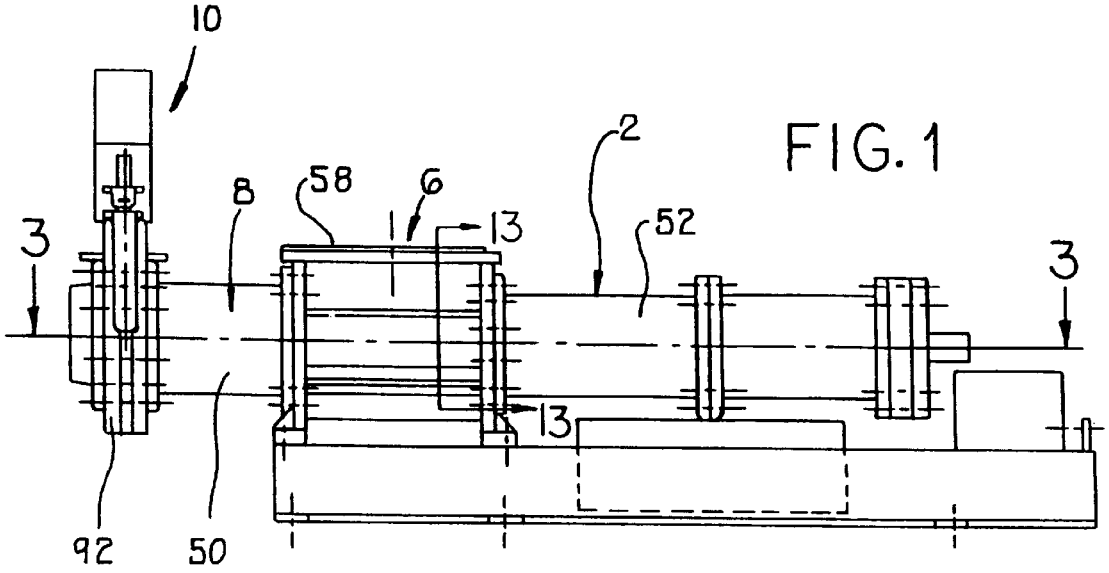
FIG. 1 is a side view of a piston pump device according to the invention.
Figure 2:
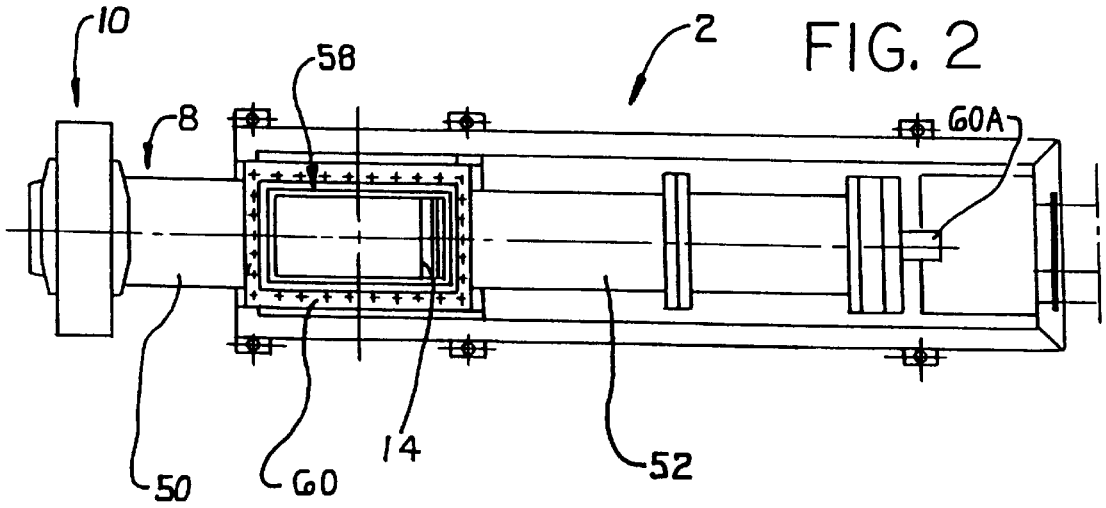
FIG. 2 is a top view of the piston pump device according to FIG. 1.

The device illustrated in the drawings is intended to be used to essentially continuously feed liquidlike, pulplike and pasty special waste to a rotary furnace for burning. Furthermore the part of the waste consisting of rusty, melted sheet-metal parts or other unburnt scrap iron from the rotary furnace are supposed to be fed again with this device to this furnace in order to reduce the remaining amount of waste accumulating after the burning and to utilize the still existing heating value of this part of the waste. While the barrels with the special waste are preshredded in a not illustrated shredder, a liquidlike or pasty carrier material, preferably also a liquidlike or pasty special waste, are mixed with the melted sheet-metal parts separated from the waste by magnetic separation before the solid thick matter mixture created thereby is fed into the rotary furnace with the device of the invention.

The illustrated device consists essentially of a hydraulically driven single piston pump 2, the conveyor piston 4 of which presses the solid thick material mixture from a feed container 6 through a conveyor cylinder 8 into a conveyor pipeline leading to the rotary furnace (not illustrated). A slide member 10, which is arranged rearwardly of the conveyor cylinder 8 and operates in correspondence with the movement of the conveyor piston, closes the conveyor pipeline prior to the pulling back of the conveyor piston 4 and in this manner prevents the mixture from being conveyed again back into the feed container 6 upon pulling back of the conveyor piston 4.

In order to prevent the sheet-metal parts or other metallic solids projecting from the conveyor cylinder 8 into the feed container 6 from leading to a jamming of the conveyor piston 4 in the conveyor cylinder 8, the conveyor piston 4 has at its forward end 12 a cutting crown 14 of a hardened steel, which during entry into the conveyor cylinder 8 for the cutting off of the projecting sheet-metal parts or other solids cooperates with a cutting ring 18 also consisting of a hardened steel. The cutting ring defines an inlet opening 16, through which the solid thick matter mixture is pressed out of the feed container 6 into the conveyor cylinder 8.

Figure 6:
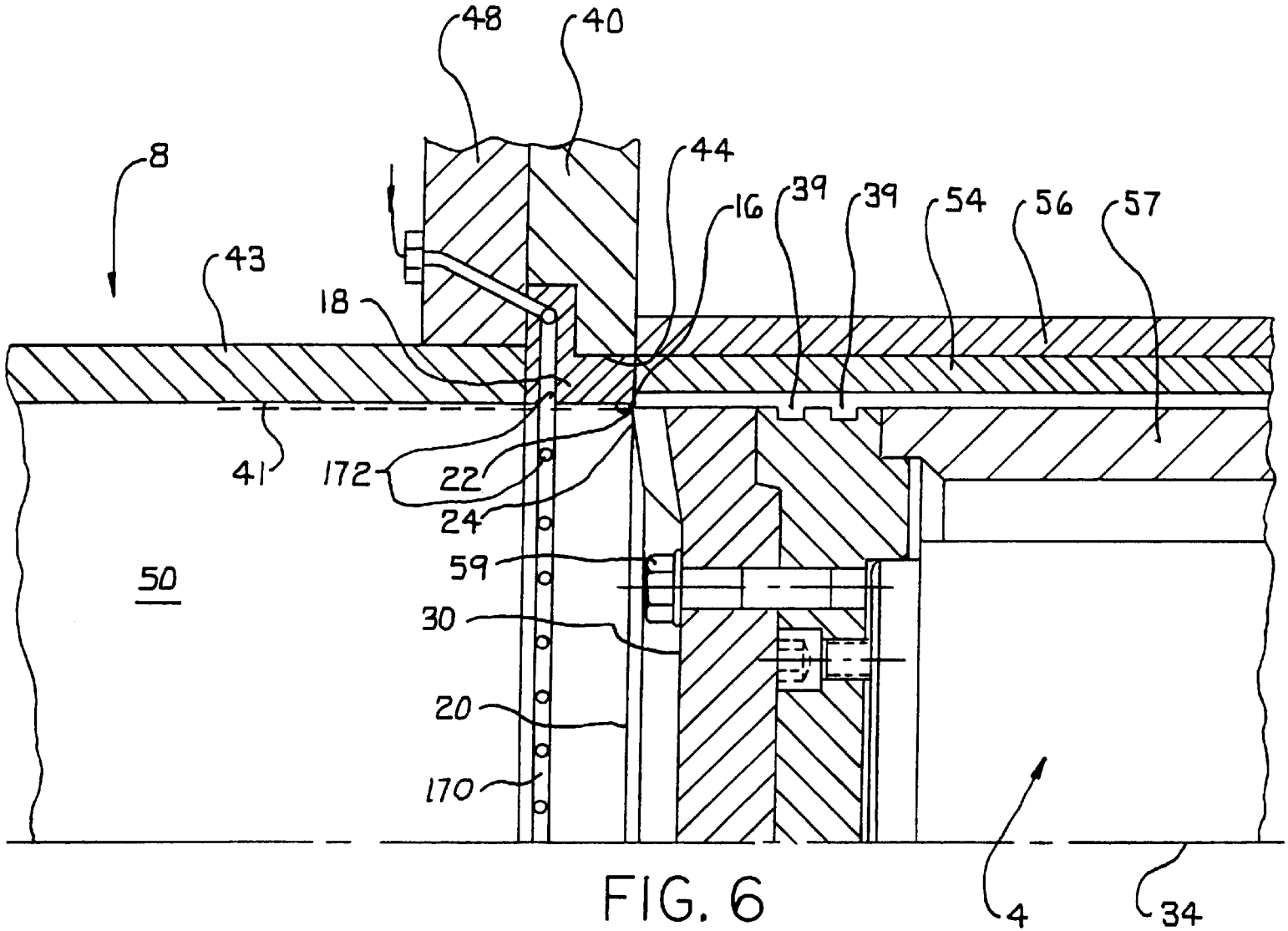
FIG. 6 is an enlarged illustration of the section Y of FIG. 3 during entry of the conveyor piston into the conveyor cylinder.

The cutting ring 18 has several lubricating openings 172, which are arranged so as to be distributed over the periphery and end in a radially inwardly open annular groove 170. The lubricating openings are supplied with lubricating oil through a central lubricating system during the pump cycle at the moment the conveyor piston 4 dips into the cutting ring 18. A significant reduction in wear of the conveyor cylinder 8 and the following conveyor pipeline results (FIG. 6).

Figure 3:
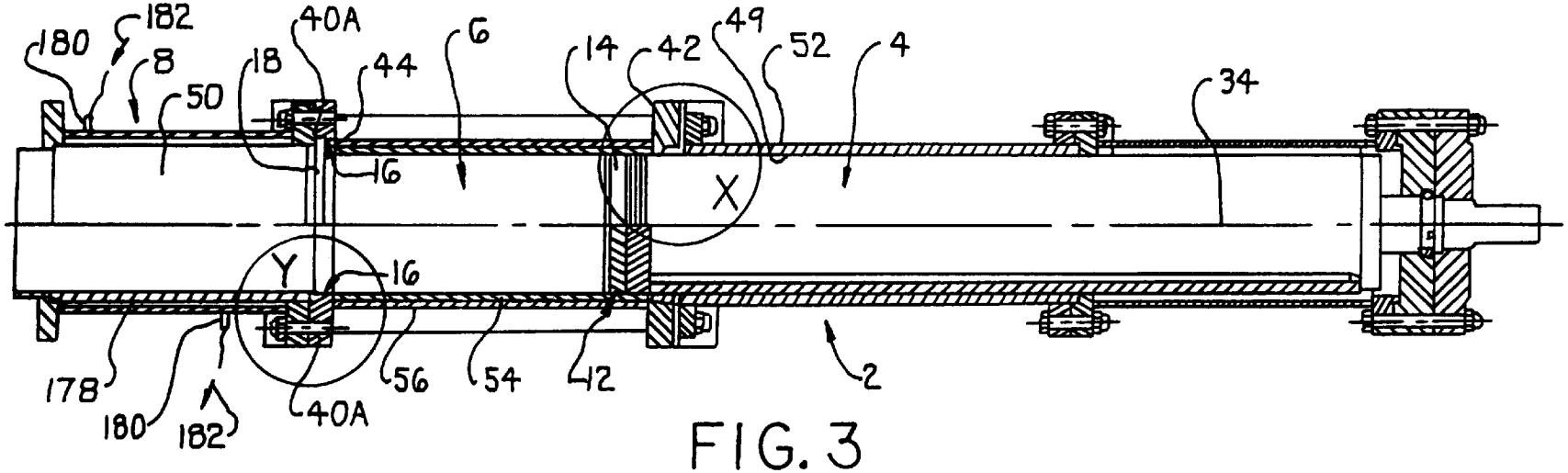
FIG. 3 is a longitudinal cross-sectional view of the piston pump device along the line 3—3 of FIG. 1.
Figure 4:
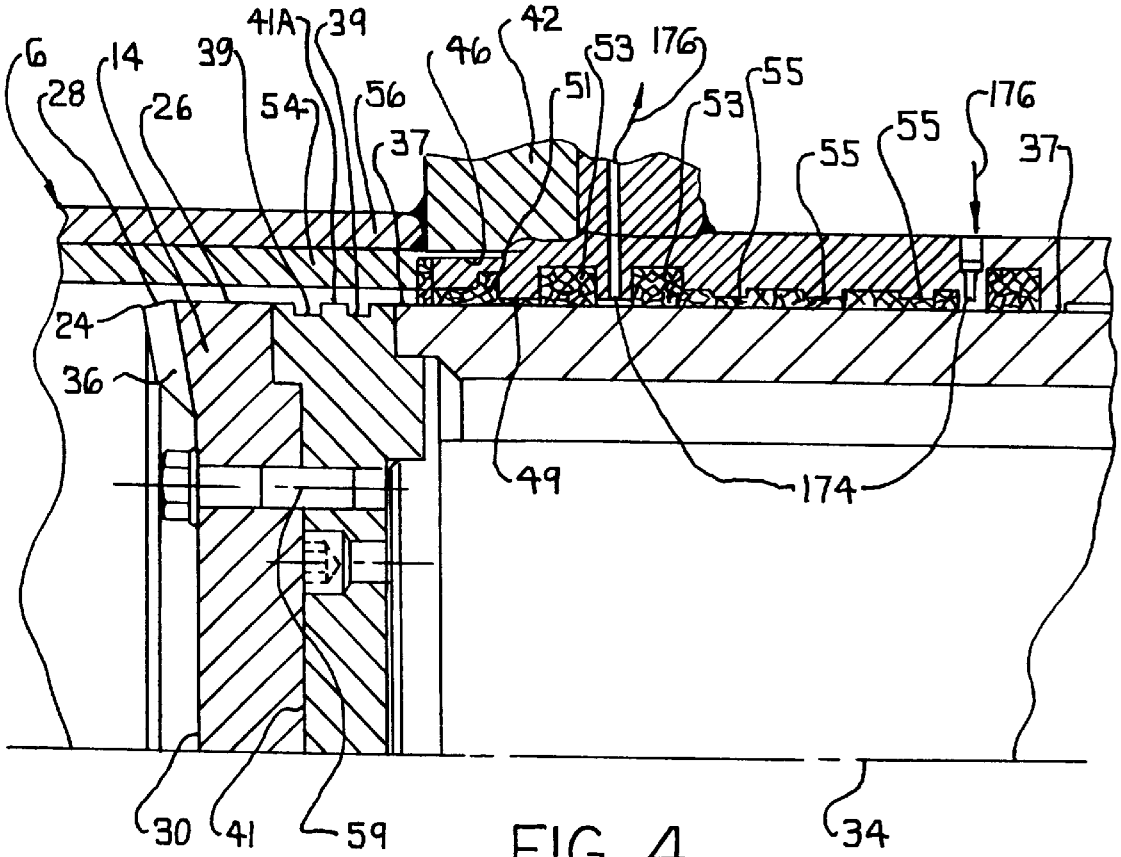
FIG. 4 is an enlarged illustration of the section X of FIG. 3.
Figure 5:
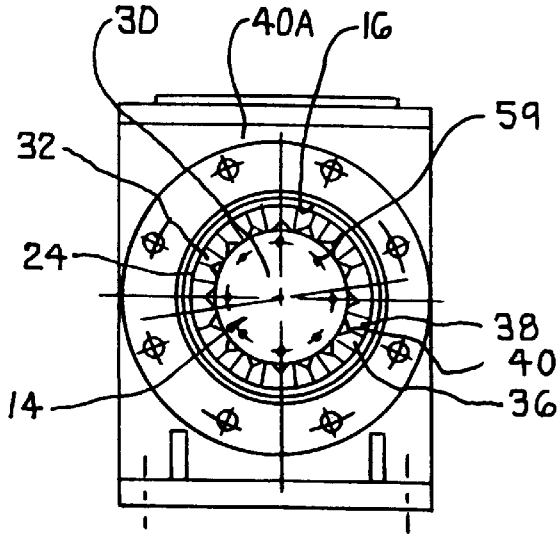
FIG. 5 is a front view of the front forward end of the conveyor piston of the piston pump device.

FIG. 3 shows that the conveyor cylinder 8 has an annular channel 178, which can be supplied with cooling water through the connections 180 in the direction of the arrows 182. The water cooling becomes necessary when the medium to be pumped is mixed with vapor.

In order to cut off the sheet-metal parts, the cutting ring 18 has at its front 20 facing the feed container 6 an edge 22 surrounding the inlet opening 16. A cutting edge 24 of the cutting crown 14 passes by said edge 22 with little spacing during entry of the conveyor piston 4 into the conveyor cylinder 8. While the edge 22 of the cutting ring 18 is circular, the cutting edge 24 runs zigzaglike or wavelike on a conical bevel surface 28 to forwardly define a cylindrical peripheral surface 26 of the cutting crown 14. This bevel surface 28 is intended to make easier the introduction of the conveyor piston 4 that is not guided in the area of the feed container 6 into the inlet opening 16. The zigzaglike cutting edge 24 thereby defines forwardly projecting cutting members 32 through a center circular front 30 of the cutting crown 14, which are constructed in one piece with the cutting crown 14, and which surround the front 30 like a ring. The cutting members 32 have a triangular cross section in a tangential direction and are defined each forwardly through guide surfaces 36, 38, 40, which are inclined rooflike toward one another and toward the piston axis 34. These guide surfaces have the effect that during entry of the conveyor piston 4 into the inlet opening 16 sheet-metal parts projecting from the conveyor cylinder 8 into the feed container 6 are moved in a tangential and in a radial direction relative to the guide surfaces 36, 38, 40, thus making the cutting off easier.

The cutting crown 14 is fastened releasably on a front face 41 of the conveyor piston 4 with axial fastening screws 59, which front face faces the conveyor cylinder 8. The tapholes for the fastening screws 59 are arranged at regular angular distances so that the cutting crown 14 can be removed during a one-sided wear of the cutting edge 24 and can again be fastened after rotation at a suitable angle about the piston axis 34.

The conveyor piston 4 has at a small distance behind the cutting crown 14 two or more annular grooves 39 arranged one behind the other on its peripheral surface 37. The annular grooves 39 have a rectangular cross section, with the relationship between their depth and their width being approximately 1:2. The distance between the two annular grooves 39 corresponds essentially with their width. The annular grooves 39 act as relief grooves with the effect that the pressure drop in the gap 41A between the peripheral surface 37 of the conveyor piston 4 and the inner surface of the conveyor cylinder 8 is enlarged compared with a conveyor piston without annular grooves, and thus the flowing back of thick matter through the gap 41A during the forward movement of the conveyor piston 4 is made more difficult. The annular grooves 39 thereby replace the elastic seals usually arranged at this point in piston pumps, which seals are not used in the piston pump of the invention since they would be quickly damaged or destroyed by the sharp sheet-metal parts.

The peripheral surface 37 of the conveyor piston 4 is hardened in order to prevent small metal particles that enter the gap 41A from resulting in damage to this peripheral surface 37.

The feed container 6 has two oppositely lying parallel walls 40A, 42 in a conveying direction of the conveyor piston 4, which each have a circular passage opening 44, 46 for the conveyor piston 4. The annular cutting ring 18, resting against an annular flange 48 at the container-side end of a first partial piece 50 of the conveyor cylinder 8, is inserted into the passage opening 44 in the wall 40A defining the feed container 6 and toward the conveyor cylinder 8 such that it can be rotated by a suitable angle where a one-sided wear occurs. A guide cylinder 52 of the single-piston pump 2, in which the conveyor piston 4 is guided, follows the passage opening 46 in the oppositely lying wall 42 of the feed container 6. The feed container 6 is defined toward the sides and in a downward direction by a trough 56, which is releasably lined on the inside with wearing plates 54, the lower part of which has a semicircular cross section. The diameter of the semicircular part of the trough cross section is thereby only a few tenth of mm larger than the diameter of the conveyor piston 4 so that it is guaranteed that on the one hand the conveyor piston 4 does not rub against the trough 56 and however, on the other side that no sheet-metal parts or other solids move into the gap between the conveyor piston 4 and the trough 56 during the forward movement of the conveyor piston 4. With this measure sheet-metal parts can project from the feed container 6 into the conveyor cylinder or pipeline 8 only in the upper part of the trough 56 when the cutting crown 14 enters into the conveyor cylinder or pipeline 8 so that on the one hand the feeding force of the conveyor piston 4, which force is needed for cutting off the sheet-metal parts, is reduced, and on the other hand the edge 22 or the cutting edge 24 does not wear in the lower half of the cutting ring 18 and the cutting crown 14. After the edge 22 or rather the cutting edge 24 has worn in the respective upper part of the cutting ring 18 or of the cutting crown 14, they can thus be rotated at 180 degrees about the piston axis 34 and consequently double their lifetime.

Figure 11:
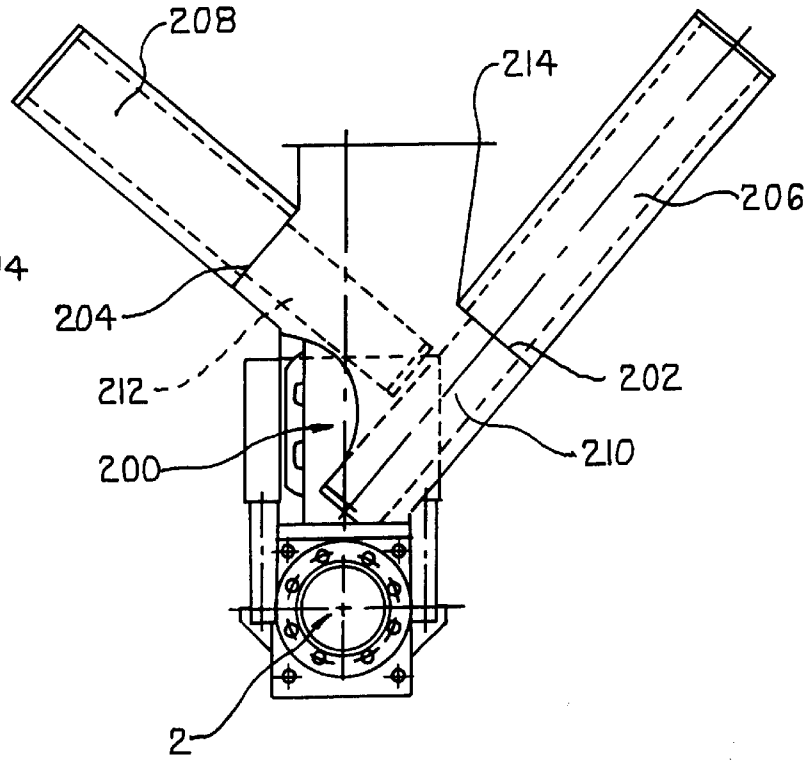
FIG. 11 is a front view of the piston pump device according to FIG. 10.
Figure 12:
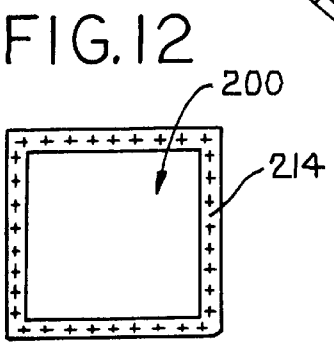
FIG. 12 is a top view of the feed chute according to FIGS. 10 and 11.
Figure 10:
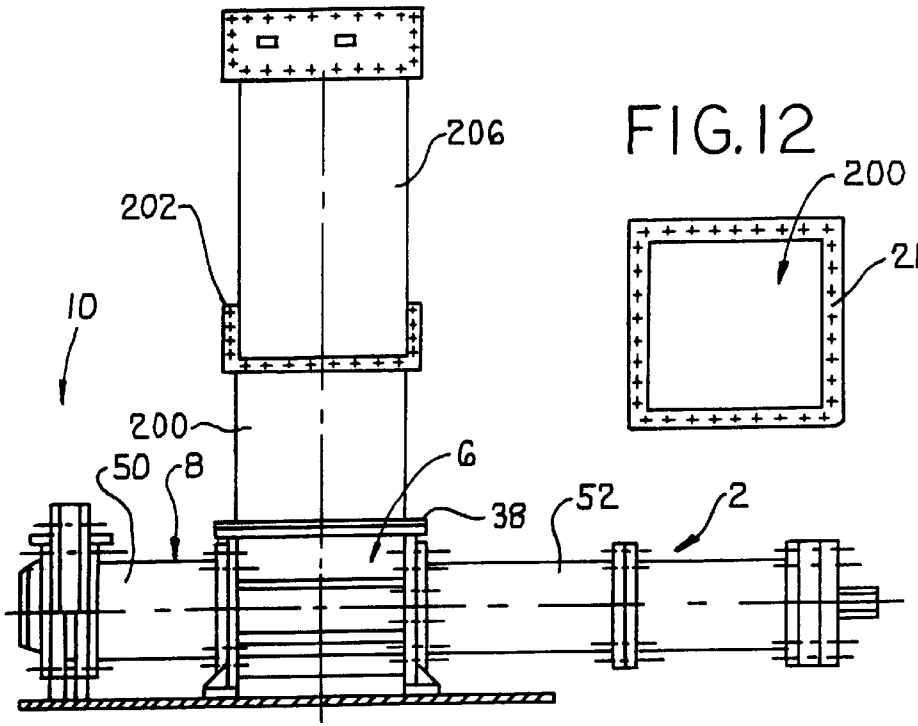
FIG. 10 shows the piston pump device in an illustration corresponding with FIG. 1 that includes a feed chute, a tamper cylinder and a bridge breaker.
Figure 13:
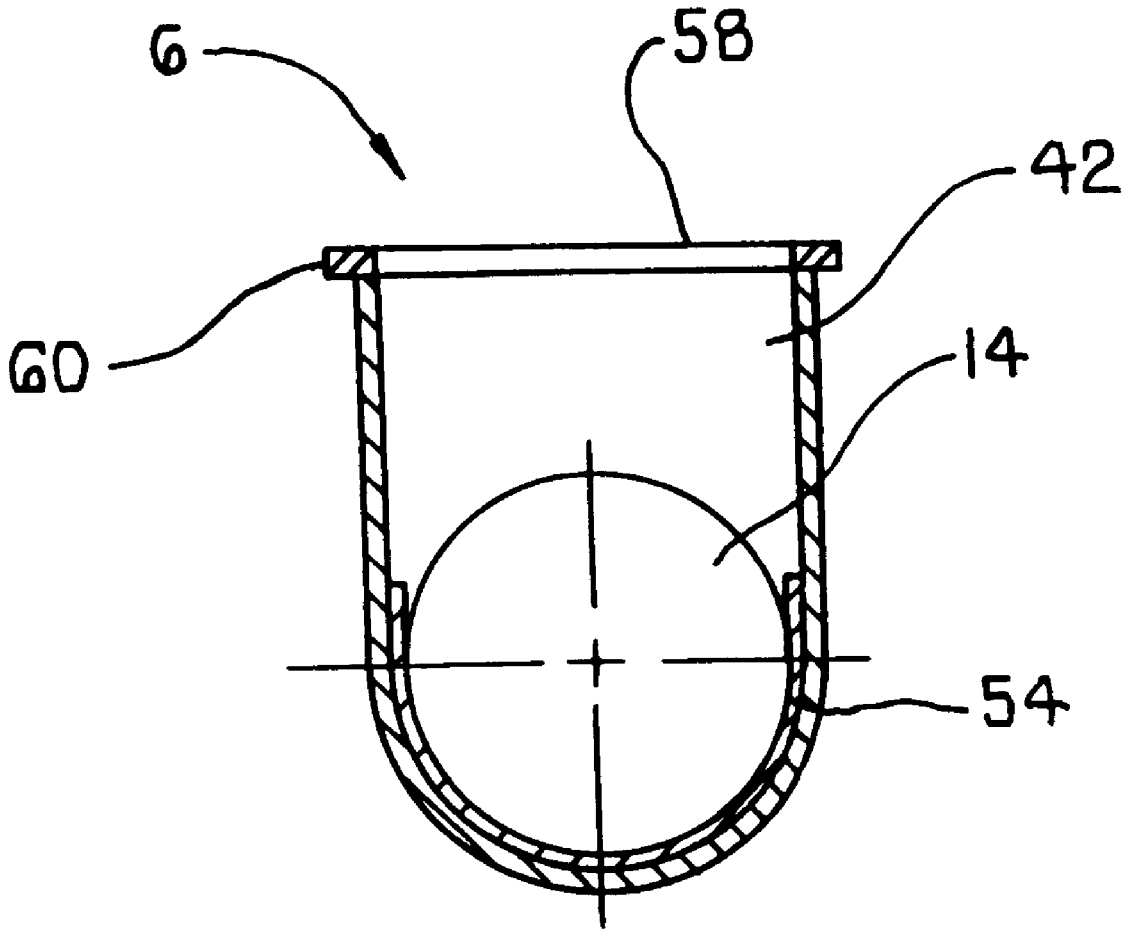
FIG. 13 is a cross sectional view of the piston pump device taken generally along line 13—13 in FIG. 3.

The feed container 6 has at its upper edge 58 a horizontal screw flange 60, on which can be mounted a funnel or feed chute 200. The feed chute has two inclined aligned sleeve flanges 202, 204, which are equipped with a hydraulic tamper cylinder 206 and a hydraulic bridge breaker cylinder 208. The tamper cylinder 206 has a piston rod 210 designed as a tamper member, which piston rod can be moved inclined in a direction of the feed container 6 into the feed chute 200. The bridge breaker cylinder 208 has a piston rod 212 designed as a bridge breaker and movable transversely with respect to the direction of movement of the tamper member 210. The piston rod 212 extends transversely through the feed chute 200 during movement. The feed chute 200 has a horizontal screw flange 214 at its upper end, on which chute can be flanged a not illustrated feed channel. As long as the conveyor piston 4 that is designed as a plunger cylinder is moved into its rear end position, the solid thick matter mixture can move through the feed chute 200 into the feed container 6. As soon as the conveyor piston 4 is moved in the conveying direction, the tamper member 210 is also moved in the direction of the feed container 6 and carries along the mixture existing in front of it so that a compression and thus a good filling ratio results. As soon as the conveyor piston 4 dips into the conveyor cylinder 8, the tamper member 210 is moved back into its end position so that new material can be supplied from above. When the conveyor piston 4 subsequently is again moved back freeing the material opening in the feed container, the bridge breaker 212 is operated in order to separate material bridges possibly occurring in the feed chute 200. The conveyor piston 4, the slide member 10, the tamper cylinder 206 and the bridge breaker cylinder 208 are controlled by a central control according to a fixed cycle (FIGS. 10 to 12).

The first partial piece 50 of the conveyor cylinder 8, which partial piece extends toward the slide member 10 and follows the feed container 6, has a cylindrical tube wall 43 consisting of hardened steel in order to prevent damage of the inner wall surface by small metal parts penetrating into the gap 41A between said surface and the conveyor piston 4. A distortion occurring during hardening of the cylindrical tube wall 43 can be compensated for by convexly prerolling the tube wall 43 so that the distortion due to hardening leads to the creation of an exactly cylindrical inner wall surface.

The guide cylinder 52 connected to the wall 42 of the feed container has a stripper 51 on its inner peripheral surface 49 in the area of the passage opening in the wall 42 and has directly behind the stripper 51 a plurality of seal rings 53 and guiding belts 55 arranged one behind the other in the conveying direction. Whereas the stripper 51 and the seal rings 53 prevent thick matter from entering between the conveyor piston 4 and the guide cylinder 52, the guiding belts 55 are used to guide the conveyor piston 4 in the guide cylinder 52. The gap between the guide cylinder 52 and the conveyor piston 4 is loaded with lubricating oil through the lubricating bores 174 in the direction of the arrows 176.

Figure 7:
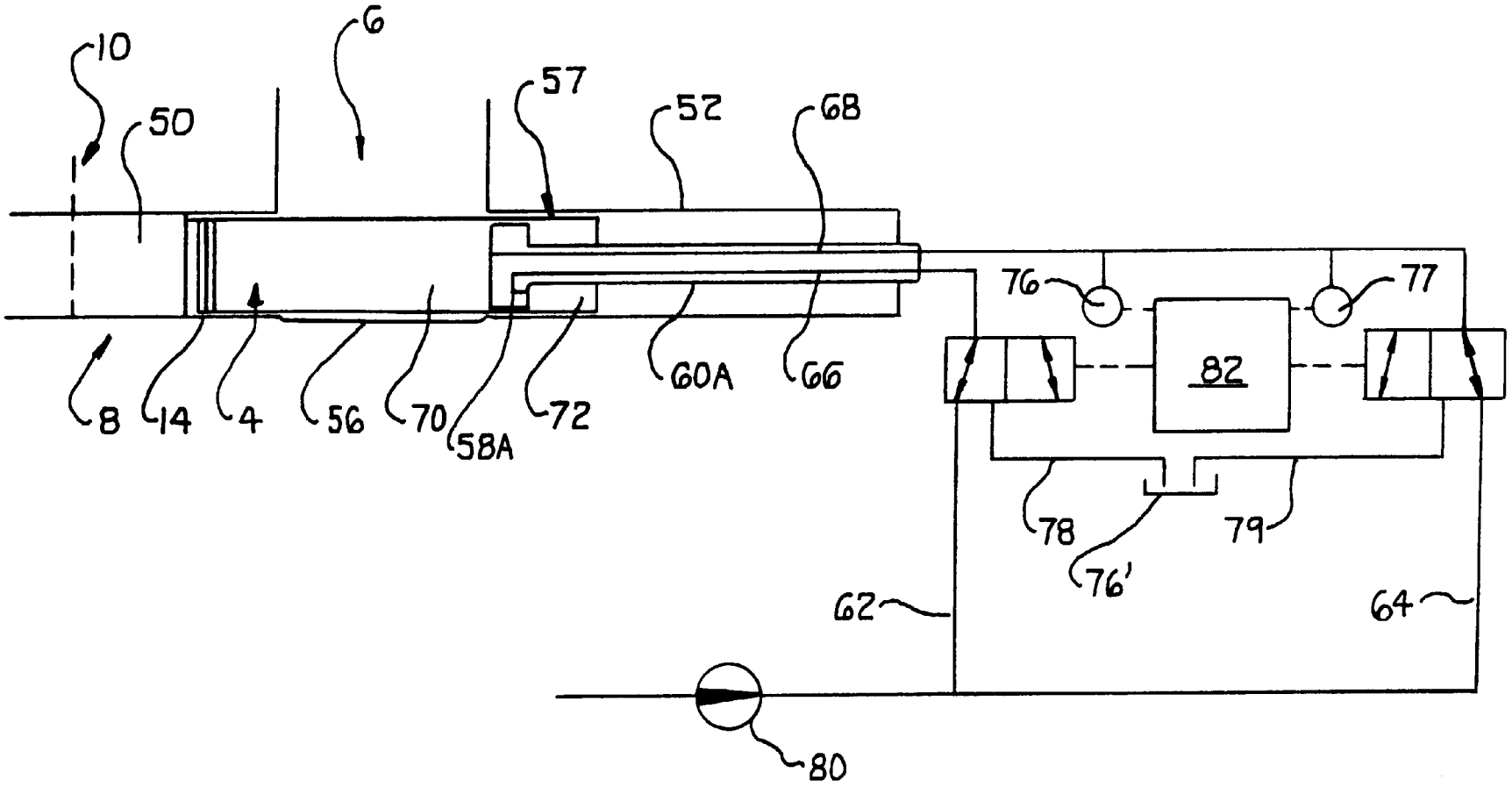
FIG. 7 is a simplified schematic illustration of the hydraulic drive of the piston pump device.
Figure 8:
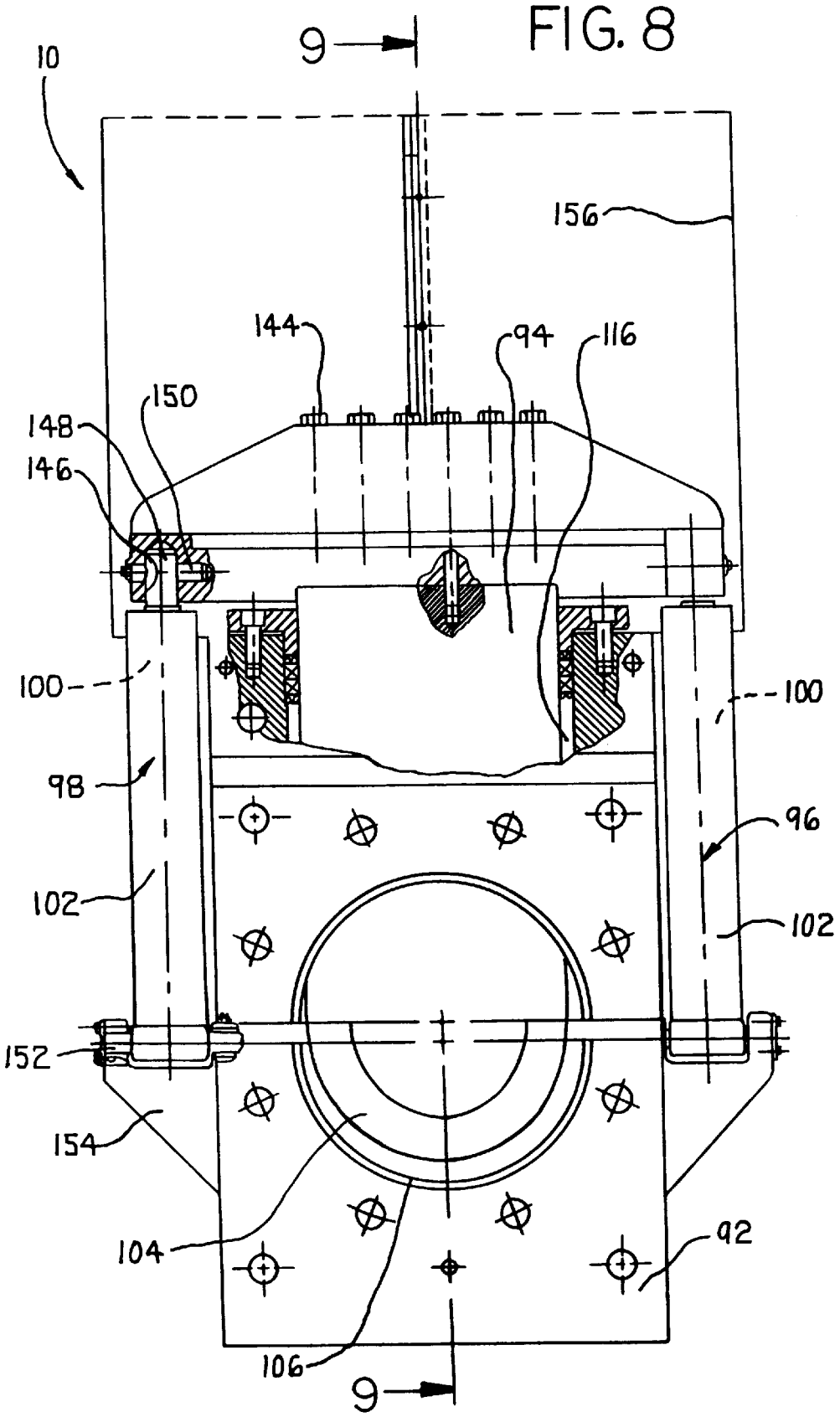
FIG. 8 is a front side view of the slide member of the piston pump device illustrated in an assembled state in FIGS. 1 and 2.
Figure 9:
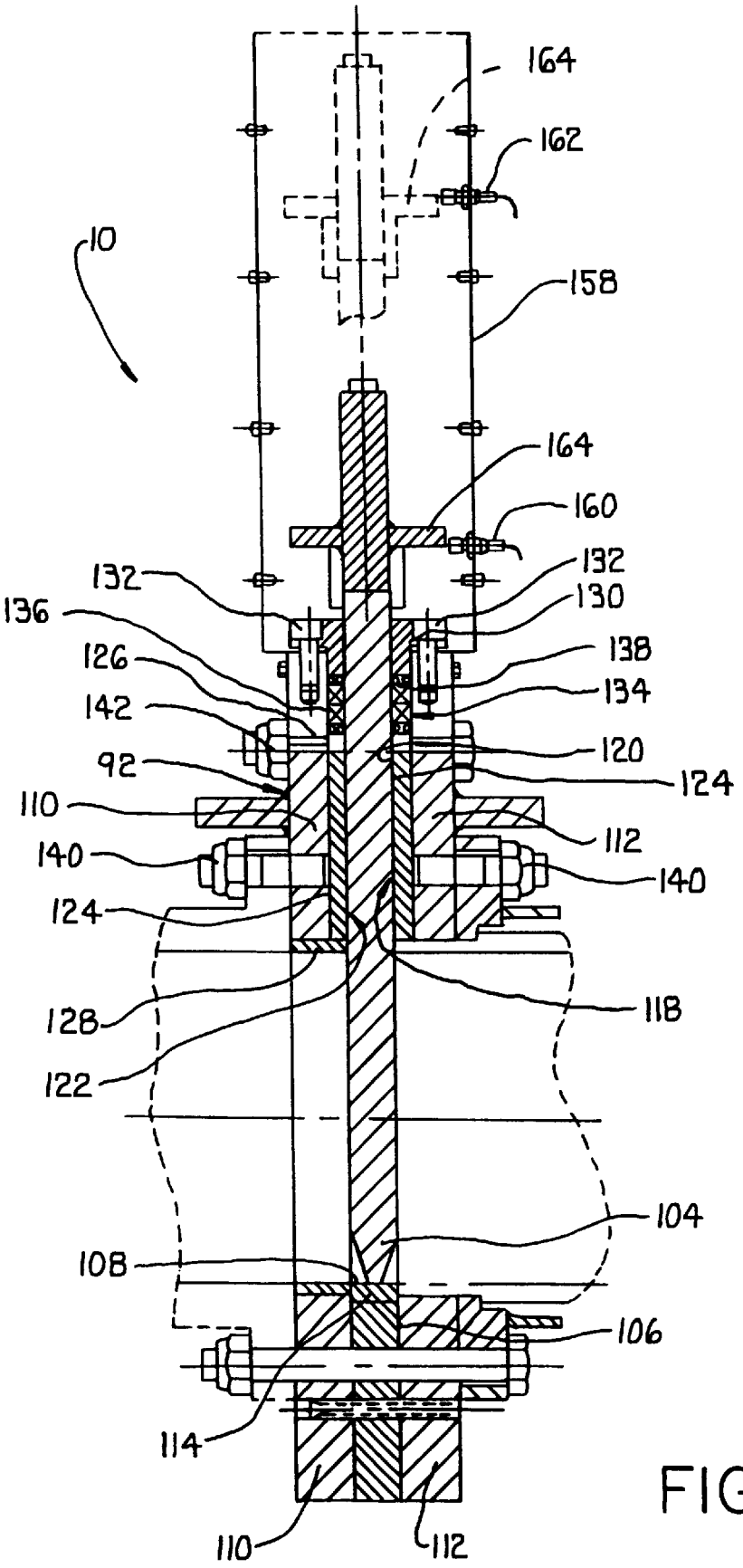
FIG. 9 is a cross-sectional view of the slide member along the line 9—9 of FIG. 8.

The conveyor piston 4, as is illustrated in a simplified manner in FIG. 7, is designed as a plunger cylinder 57, which is movable relative to a piston 58A of a piston rod 60A, which is arranged stationarily in the guide cylinder 52. The piston rod 60A has two pressure oil channels 66, 68, which can each be connected alternatively to a pressure oil feed pipeline 62, 64 or to a return pipeline 78, 79 leading to a return tank 76', and of which the one ends in a pressure chamber 70, which is arranged on the conveying side between the piston 58A and the plunger cylinder 57, and the other one ends in a pressure chamber 72, which is arranged on the rod side between the piston 58A and the plunger cylinder 57. The active piston surface in the pressure chamber 70, which is on the conveying side, is about twice as large as the active piston surface in the pressure chamber 72, which is on the rod side, since the cross section of the piston rod 60 is half as large as the cross section of the pressure chamber 70 on the conveying side. The two pressure chambers 70, 72 are connected by a closable connecting pipeline (not illustrated), which is open during a common loading of the two pressure chambers 70, 72 with pressure oil (differential control) so that a pressure balance is created and pressure oil can be moved from the pressure chamber 72 on the side of the rod to the pressure chamber 70 on the conveying side.

The pressure in the pressure oil channel 68 is monitored by two pressure receivers 76, 77, which when exceeding a predetermined pressure during the feeding movement of the plunger cylinder 57 load a control unit 82 with a control signal.

During the normal operation of the device, both pressure chambers 70, 72 are with the balancing pipeline being open controlled with a differential control and are loaded with pressure through the pressure oil feed pipelines 62, 64 and the pressure oil channels 66, 68 connected to these pipelines. Since only the rod surface is thereby available as an active area, the plunger cylinder 57 is indeed moved forwardly with a relatively low feeding force, however, with a relatively high feeding speed. If, however, a sheet-metal strip with a greater material thickness projects during entry of the conveyor piston 4 into the conveyor pipeline 8 from same into the feed container 6, which strip cannot easily be cut off between the edge 22 and the cutting edge 24, then a pressure builds up in the pressure chambers 70, 72 and in the pressure oil channels 66, 68, which upon exceeding the specified value or threshhold at the first pressure receiver 76 results in the control unit 82 closing the connection of the pressure oil channel 66 to the pressure oil feed pipeline 62 and connecting the pressure chamber 72 to the return pipeline 78 so that only the pressure chamber 70 on the conveying side is loaded with pressure oil, whereas the pressure chamber 72 on the side of the rod is switched to no pressure. With this, the feeding force and thus the cutting force between the cutting edge 24 and the edge 22 is doubled with a simultaneous cutting in half of the feeding speed at a constant conveying capacity of the driving pump 80.

Even if the doubling of the feeding force does not result in a cutting off of the sheet-metal strip clamped between the cutting edge 24 and the edge 22, the pressure in the pressure oil cycle increases further until it exceeds the specified value or threshold at the second pressure receiver 77 and the control unit 82 receives a signal from same. The control unit 82 subsequently connects the pressure oil channel 68 to the return pipeline 79 and the pressure oil channel 66 to the pressure oil feed pipeline 62 so that now only the pressure chamber 72 on the side of the rod is loaded with pressure and the plunger cylinder 57 is pulled back. During the pulling back of the conveyor piston 4, the suction in the feed container 6 has the effect such that thick matter collapses, whereby mostly the metal strip blocking the feeding movement of the conveyor piston 4 also is shifted. The plunger cylinder 57 is, after reaching its end position, again moved forwardly, with the pulling back and the forward movement able to be repeated several times prior to the piston pump being stopped for the manual removal of the sheet-metal strip.

The slide member 10 arranged in the conveyor pipeline 8 consists essentially of a slide plate 94, which is guided movably in a vertical direction in a slide flange 92, and which, when the slide member 10 is open, completely frees the conveyor pipeline 8 and completely closes same when the slide member 10 is closed. The spadelike slide plate 94 is movable by means of two hydraulic cylinders 96, 98, which each engage with their piston rod 100 on the slide plate 94 and with their cylinder 102 on the slide flange 92 built into the conveyor pipelines.

The part of the slide plate 94 engaging the conveyor pipeline 8 is defined downwardly by a semicircular edge 104 adapted to the inside cross section of the conveyor pipeline 8, which edge 104, when the slide member 10 is closed, rests with a semicylindrical stop surface 106 on an also semicylindrical stop surface 108 of a stop plate 114 inserted between two parallel flange plates 110, 112 of the slide flange 92. The slide plate 94 is guided through the conveyor pipeline 8 in a guiding chute 116, which is arranged between the flange plates 110, 112 and has a guiding slot 118, which is rectangular in cross section, the wide side surfaces 122 of which that lie opposite one another are opposite the wide side surfaces 124 of the slide plate 94 with each leaving a narrow gap 120.

The edge 104 of the slide plate 94 has in the conveying direction a cross section, which tapers keylike toward the stop surface 106, and which guarantees that the small metal parts, which penetrate into the narrow gap 120 between the slide plate 94 and the guiding chute 116 when the slide plate 94 is pulled out of the conveyor pipeline 8, are during the subsequent moving of the slide plate 94 into the conveyor pipeline 8 again moved by said plate in the direction of the conveyor pipeline 8 out of the gap 120 and do not settle between the slide plate 94 and the guiding chute 116.

The guiding chute 116 is designed in two parts, with the lower part 126 being supported against a ring 128 defining the flange plates 110, 112 toward the inside of the conveyor pipeline 8, and with the upper part 130 being pulled by adjusting screws 132 extending into tapholes of the flange plates 110, 112 toward a set of seals 134 resting on the upper side of the lower part 126. The set of seals 134 consist of elastic seals 136, 138 that extend around the slide plate 94 which is thereby compressed, whereby the seals 136, 138 rest against the slide plate 94.

The two partial pieces of the conveyor pipeline 8 in front of and behind the slide member 10 are each held on the flange plates 110, 112 by fastening screws 140 engaging tapholes of the flange plates 110, 112. The flange plates themselves are connected by connecting screws 142.

The slide plate 94 is also designed in two parts, whereby the lower part extending into the guiding slot 118 of the guiding chute 116 is connected to the upper part by holding screws 144, which upper part projects over the flange plates 110, 112 transversely with respect to the conveying direction and has downwardly pointing cylindrical receiving means 146, in which cylindrical pegs 148 each projecting on the face side over the piston rods 100 of the hydraulic cylinders 96, 98 are fastened with holding bolts 150.

The hydraulic cylinders 96, 98 are pivotally supported on swivel bolts 152 on the side of the cylinder, which swivel bolts are inserted in mountings 154 laterally projecting over the flange plates 110, 112.

A closed sheet-metal housing 156 is mounted on the flange plates 110, 112, in which housing the slide plate 94 moves upwardly so as to be protected against outside influences when being pulled out. Two approximation switches 160, 162 are inserted into the wall 158 of the sheet-metal housing 156, which switches react each in the upper and lower end position of the slide plate 94 upon the approach of a flange 164 projecting over the slide plate 94 in the conveying direction.

The signal supplied by the end switches of the control unit 82 is used for closing the pressure oil supply to the hydraulic cylinders 96, 98 upon reaching the upper or instead the lower end position of the slide plate 94 and for subsequently starting the forward movement or instead the pulling back movement of the conveyor piston 4, which cycles synchronously with the slide member 10.

The slide member 10 is arranged directly behind the point in the conveyor pipeline 8, at which, with the conveyor piston 4 being fully moved out, its forward end 12 is provided. With this it is achieved that during the pulling back of the conveyor piston 4 on the container side of the slide member 10 there is no longer any thick matter in the conveyor cylinder 8, which thick matter could be sucked back to the feed container 6.

The embodiments of the invention in which an exclusive property or privilege is claimed are defined as follows:

1. A method for conveying thick matter containing shredded scrap metal or similar solids using a feed container and a conveyor cylinder having an inlet opening on an inlet side connected to the feed container, a conveyor piston having a forward end and adapted for advancement along a path through the feed container and into the conveyor cylinder during a piston stroke, the inlet opening of the conveyor cylinder permitting passage therein of the conveyor piston during the piston stroke, the method including the steps of:

pressing the thick matter from the feed container into the conveyor cylinder during forward movement of the conveyor piston along the path during a piston stroke, such pressing of the thick matter being capable of cutting off solids in the feed container projecting over the inlet opening at the inlet side of the conveyor cylinder as the conveyor piston advances along the path through the feed container and the forward end of the piston enters into the conveyor cylinder;

increasing the feeding force of the conveyor piston when a first specified pressure in a medium that drives the conveyor piston is exceeded;

retracting the conveyor piston when (a) the medium that drives the conveyor piston exceeds a second specified pressure greater than the first specified pressure to create a suction in the feed container for causing shifting of a solid body preventing movement of the piston, or (b) the conveyor piston has reached a position corresponding to a complete extension of the conveyor piston during a piston stroke; and repeating forward movement of the piston after retraction thereof.

2. The method according to claim 1, wherein the solids are cut off between at least one edge surrounding the inlet opening and at least one cutting edge arranged on the forward end of the conveyor piston.

3. The method according to claim 1, wherein a rotary movement is superposed over translational movement of the conveyor piston.

4. The method of claim 1, wherein the advance of the piston into the conveyor cylinder advances the thick matter containing shredded scrap metal or similar solids along the conveyor cylinder toward a rotary furnace.

5. The method according to claim 1, wherein a slide member arranged in the conveyor cylinder is closed prior to retraction of the conveyor piston from the position corresponding to a complete extension of the piston during a piston stroke.

6. The method according to claim 5, wherein during closing of the slide member, solids existing in a path of movement of a slide plate engaging the conveyor cylinder are jammed between the slide plate and a wall of the conveyor cylinder.

7. A method for conveying thick matter containing shredded scrap metal or similar solids using a feed container and a conveyor cylinder having an inlet opening on an inlet side connected to the feed container, a conveyor piston having a piston stroke for advancement through the feed container and into the conveyor cylinder, the method including the steps of:

pressing the thick matter from the feed container into the conveyor cylinder using forward movement of the conveyor piston during a piston stroke, such pressing of the thick matter being capable of cutting off solids in the feed container projecting over the inlet opening at the inlet side of the conveyor cylinder as the piston advances through the feed container and the forward end of the piston enters into the conveyor cylinder;

retracting the conveyor piston when:

a) the medium that drives the conveyor piston exceeds a specified pressure, retraction of the conveyor piston creating a suction in at least one of the conveyor cylinder and the feed container for causing a solid body blocking the conveyor piston from entering the conveyor cylinder to shift to a position enabling movement of the solid body into the conveyor cylinder or to a position enabling cutting of the solid body by the piston, or b) the conveyor piston has reached a position at least partially within the conveyor cylinder corresponding to a complete extension of the piston stroke thereof; and repeating forward movement of the conveyor piston after retraction to a rear end position thereof.

8. The method according to claim 7, wherein a slide member arranged in the conveyor cylinder is closed prior to retraction of the conveyor piston from the conveyor cylinder from the position corresponding to a complete extension of the piston during a piston stroke.

9. The method according to claim 7, wherein the solids are cut off by at least one edge arranged on the front forward end of the conveyor piston.

10. The method according to claim 7, wherein a rotary movement is superposed over translational movement of the conveyor piston.

11. A method for conveying thick matter containing shredded scrap metal or similar solids in a feed container through a conveyor cylinder, wherein a cutting ring is disposed at an inlet between the feed conveyor and the conveyor cylinder, comprising the steps of:

pressing the thick matter in a feed container toward the conveyor cylinder using a conveyor piston having a cutting crown at a forward end thereof, the pressing of the thick matter being capable of causing movement of sheet-metal parts in the thick matter projecting from the conveyor cylinder and into the feed container in a tangential and in a radial direction relative to guide surfaces of the cutting crown of the conveyor piston; and sensing when the medium that drives the conveyor piston exceeds a specified pressure; and, if the specified pressure is exceeded, retracting the conveyor piston to a rear end position and thereby creating a suction in at least one of the conveyor cylinder and the feed container capable of causing a solid body preventing the conveyor piston from entering the conveyor cylinder to shift to a position enabling movement of the solid body into the conveyor cylinder or a position enabling the cutting crown of the conveyor piston to cut the solid body against the cutting ring during entry of the conveyor piston into the conveyor cylinder; if the specified pressure not is exceeded, lowering a slide member in the conveyor cylinder to close off the conveyor cylinder and retracting the conveyor piston to the rear end position.

12. The method of claim 11, wherein a force of the conveyor piston presses the thick matter toward the conveyor cylinder, the force increasing upon a pressure exceeding a specific pressure in a medium that drives the conveyor piston.

13. The method of claim 11, wherein the slide member opens the conveyor cylinder prior to a pressure stroke of the conveyor piston.

14. The method of claim 11, wherein a rotary movement is superposed over translational movement of the conveyor piston.

15. The method of claim 11, further including the steps of, when the conveyor piston is at the rear end position:

moving thick matter into the feed container via a feed chute; and moving the thick matter into the feed container from the feed chute using a tamper member.

16. The method of claim 15, wherein when the conveyor piston and the tamper member are at respective rear end positions, a bridge breaker enters the feed chute to break scrap metal parts in the feed chute.

* * * * *